United States Patent [19]

Spitz

[11] Patent Number: 4,855,883

[45] Date of Patent: Aug. 8, 1989

[54] FLUORESCENT LIGHTING APPARATUS

[76] Inventor: Russell W. Spitz, 2999 Hartley Rd., Ste. 301, Bldg. C, Jacksonville, Fla. 33217

[21] Appl. No.: 123,705

[22] Filed: Nov. 23, 1987

Related U.S. Application Data

[63] Continuation-in-part of Ser. No. 865,411, May 21, 1986, Pat. No. 4,719,546.

[51] Int. Cl.[4] ..... F21V 7/12

[52] U.S. Cl. ..... 362/260; 362/346; 362/349; 362/217

[58] Field of Search ..... 362/217, 260, 346, 349

[56] References Cited

U.S. PATENT DOCUMENTS

| | | | |
|---|---|---|---|
| 2,291,489 | 7/1942 | Naysmith . | |
| 2,418,195 | 4/1947 | Rolph . | |
| 2,591,661 | 4/1952 | McCandless | 362/217 |
| 2,740,885 | 4/1956 | Kruger . | |
| 3,125,301 | 3/1964 | Stotter | 362/217 |
| 3,159,352 | 12/1964 | Wakefield et al. | 240/51 |
| 3,829,677 | 8/1974 | DeLano . | |
| 4,112,483 | 9/1978 | Small, Jr. et al. | 362/217 |
| 4,242,725 | 12/1980 | Douma et al. | 362/341 |
| 4,336,576 | 6/1982 | Crabtree | 362/240 |
| 4,388,675 | 6/1983 | Lewin | 362/225 |
| 4,403,275 | 9/1983 | Oser | 362/220 |
| 4,459,647 | 7/1984 | Yamauchi et al. | 362/346 |
| 4,499,529 | 2/1985 | Figueroa | 362/217 |
| 4,536,830 | 8/1985 | Wisniewski | 362/223 |
| 4,562,517 | 12/1985 | Pankin | 362/217 |
| 4,564,888 | 1/1986 | Lewin et al. | 362/147 |
| 4,669,033 | 5/1987 | Lee | 362/217 |
| 4,719,546 | 1/1988 | Spitz | 362/260 |

FOREIGN PATENT DOCUMENTS

| | | | |
|---|---|---|---|
| 0084934 | 8/1983 | United Kingdom | 362/346 |

*Primary Examiner*—Ira S. Lazarus
*Assistant Examiner*—Sue Hagarman
*Attorney, Agent, or Firm*—Harpman & Harpman

[57] ABSTRACT

Fluorescent lighting apparatus utilizing a single elongated tubular light source replaces the multiple fluorescent tubular light sources of conventional or prior art fluorescent lighting apparatus. A substantial part of the light output of the fluorescent tubular light source is reflected by an improved reflector construction having multiple elongated strip-like mirror surfaces. A simplied, less expensive, more efficient apparatus is disclosed wherein the improved reflector forms the principal part of the apparatus and is provided with a compact raceway for the current carrying wires along with a remotely situated ballast in a compact enclosure which facilitates the adaptation of the improved apparatus to surface mounting on ceilings as well as recessed mounting of the fluorescent apparatus in suspended ceilings and the like.

15 Claims, 2 Drawing Sheets

FLUORESCENT LIGHTING APPARATUS

This is a continuation-in-part of application Ser. No. 865,411 filed 5/21/86 now U.S. Pat. No. 4,719,546.

BACKGROUND OF THE INVENTION

1. Technical Field

This invention relates to fluorescent lighting apparatus of the type utilizing elongated fluorescent tubes in or on fixtures mounted on the ceiling of an enclosure to be illuminated thereby.

2. Description of the Prior Art

Prior fluorescent lighting apparatus such as used in commercial applications including retail stores and the like have generally utilized two or more fluorescent tubes positioned in side by side relation on or in a fixture usually having a white painted reflective surface. My copending application for patent entitled "Fluorescent Lighting Apparatus", Ser. No. 06/865,411, filed 5/21/86 now U.S. Pat. No. 4,719,546, which patent is hereby expressly incorporated by reference herein. illustrates an improved reflector structure which is particularly suitable in the present improved fluorescent lighting apparatus.

A further prior art luminaire is disclosed in U.S. Pat. No. 3,159,352 wherein an improved refractor is positioned below the fluorescent tubes in the fixture for improving the distribution of the light output therefrom.

The present invention substantially improves the fluorescent lighting apparatus by incorporating the reflector of my copending patent application as the principal structural portion of the apparatus in which the fluorescent tube and reflector are positioned and substitutes a wiring raceway for the usual complicated, expensive and large ballast enclosures and efficiently and practically positions the ballast of the apparatus in any one of a number of locations adjacent the apparatus or incorporated therein which measurably contributes to the aesthetic appearance of the improved apparatus enabling it to be installed on the surface of ceilings with none of the bulky objectional visual appearance of the prior art devices.

SUMMARY OF THE INVENTION

The fluorescent lighting apparatus disclosed herein positions an elongated fluorescent tube in a reflector having a plurality of elongated transversely flat silver light reflecting surfaces, the reflector forming the principal body of the apparatus and to which only an elongated wiring raceway is added to provide electrical conductor connections with the lamp hangers of the apparatus which receive support and energize the fluorescent tube lighting source. The necessary ballast is enclosed in a separate housing which can be positioned on the reflector structure in a desired space saving location or alternately remotely positioned and electrically connected with the apparatus by way of the raceway which also lends longitudinal support to the reflector structure comprising the principal body of the apparatus.

DESCRIPTION OF THE PREFERRED EMBODIMENT

Figure 1:
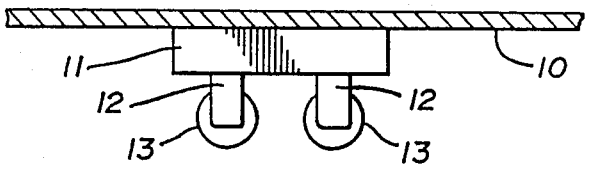
PRIOR ART FIG. 1
FIG. 1 is an end elevation of a conventional prior art fluorescent lighting fixture on a supporting ceiling surface.

By referring to the drawings and FIG. 1 in particular, a typical prior art fluorescent lighting fixture such as used in commercial installations may be seen affixed to a ceiling surface 10, the fixture comprising a metal housing 11 in which a usual ballast, not shown, in positioned and a pair of lamp holders 12 adjacent one end of the metal housing 11 which with a similar pair of lamp holders on the other end of the metal housing 11 support and energize a pair of fluorescent tubes 13. The metal housing 11 is usually painted white in an effort to reflect some of the light from the fluorescent tubes downwardly and away from the fixture.

Figure 2:
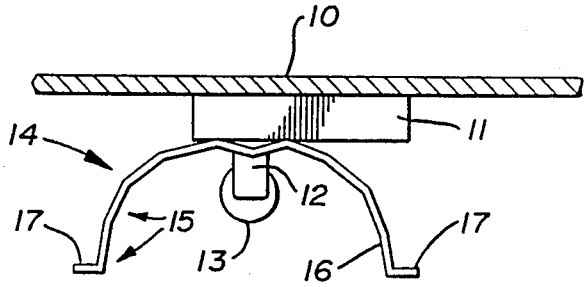
FIG. 2 is an end elevation of the fluorescent lighting apparatus of my copending patent application, now U.S. Pat. No. 4,719,546 applied to a single fluorescent tube of a multiple fluorescent tube fixture.

In FIG. 2 of the drawings, the ceiling surface 10 is illustrated along with the metal housing 11 and one of the lamp holders 12 together with one fluorescent tube 13 which is held at both ends by lamp holders 12 as will be understood by those skilled in the art.

In FIG. 2 of the drawings, a reflector structure 14 of a modified arcuate shape is illustrated symbolically as having a plurality of longitudinally extending, transversely flat light reflective portions 15 positioned radially of said fluorescent tube 13 so as to partially surround the same. The reflector structure 14 and its light reflective portions 15 are representative of my copending patent application Ser. No. 06/865,411, now U.S. Pat. No. 4,719,546.

The several light reflective portions 15 are arranged in edge to edge relation and comprise silver light reflecting material 16. The reflector structure 44 has longitudinally extending outturned flanges 17 defining its longitudinal edges.

Figure 3:
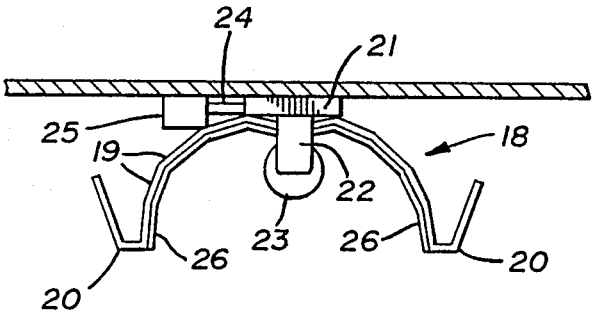
FIG. 3 is an end elevation of the fluorescent lighting apparatus embodying the present invention on a supporting ceiling.

By referring now to FIG. 3 of the drawings, an end elevation of the improved fluorescent lighting apparatus of the present invention may be seen wherein an elongated structure 18 of a modified arcuate shape incorporating a plurality of longitudinally extending, transversely flat sections 19 comprises the principal part of the improved lighting apparatus. Outturned flanges 20 define the longitudinal edges of the elongated structure 18 and an elongated raceway 21 is attached to the uppermost portion of the elongated structure 18 and supports a pair of lamp holders 22, only one being shown in FIG. 3, between which a fluorescent tube 23 is supported and energized. Electrical conductors, not shown, are disposed in the raceway 21 and extend by way of a conduit 24 to a ballast containing enclosure or box 25 in the form of the invention illustrated in FIG. 3. A silver light reflecting material 26 is positioned on the sections 19 of the elongated structure 18 to reflect light from the fluorescent tube 23 downwardly and outwardly of the area of the apparatus between the outturned flanges 20. The improved fixture as illustrated in FIG. 3 and hereinbefore described will be seen to have a very compact vertical height as compared with fluorescent fixtures and apparatus heretofore known in the art and a considerably simplified structure consisting essentially of the elongated structure 18 of the modified arcuate shape and the raceway 21 which enables the entire apparatus to be surface mounted on a ceiling so that when viewed from below it closely resembles the typical recessed fluorescent fixture of the prior art which is considerably more expensive in construction and greatly more expensive to install.

Figure 4:
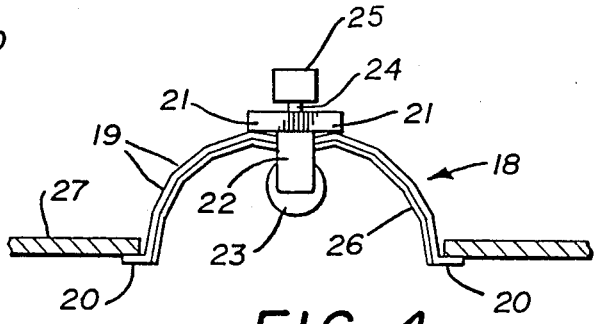
FIG. 4 is an end elevation of the fluorescent lighting apparatus embodying the present invention in a fixture positioned above an opening in a ceiling.

By referring now to FIG. 4 of the drawings, the improved fluorescent apparatus of the present invention will be seen to be readily adaptable to so-called recessed installation wherein it is positioned in an opening in a ceiling 27 with its longitudinally extending flanges 20 preferably underlying the ceiling 27.

In the form of the invention illustrated in FIG. 4 of the drawings, the raceway 21 remains on the upper surface of the elongated structure 18, the reflective material 26 is positioned on the inner surfaces of the sections 19 of the elongated structure 18 and the ballast box 25 and its connecting conduit 24 are positioned on the upper side of the raceway 21. It will occur to those skilled in the art that the improved apparatus illustrated in FIG. 4 may be suspended from an overhead structure below which the ceiling 27 is positioned or alternately if the ceiling structure 27 is suitable, mounting means positioned thereon and engaging the opening therein will adequately support the apparatus.

Figure 5:
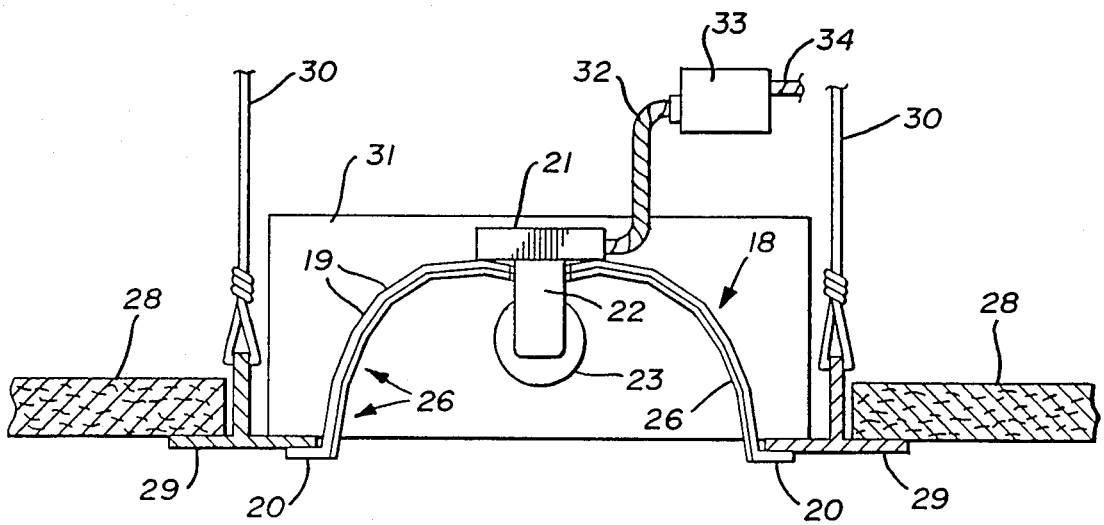
FIG. 5 is an enlarged cross sectional elevation of a fluorescent lighting apparatus embodying the present invention supported on hangers in an opening in a ceiling and illustrating a remotely located ballast and enclosure.

By referring now to FIG. 5 of the drawings, the improved apparatus of the present invention may be seen installed as a recessed fixture in an opening in a ceiling 28, the ceiling 28 being supported by T-shaped hangers 29 which in turn are positioned by support wires 30 as customary in the art. The improved apparatus comprising the elongated structure 18 with its flat sections 19, the raceway 21 secured to the top of the elongated structure 18, and the pairs of light hangers 22 which support the fluorescent tube 23, it being observed that the light hangers 22 extend upwardly through notches in the ends of the elongated structure 18 and are attached to the raceway 21 so as to be supported thereby. Electrical conductors, not shown, extend from the light hangers 22 into the raceway 21 and from the same by way of a flexible cable or conduit 32 to a remotely positioned ballast box 33. Electrical current is supplied the ballast in the ballast box 33 by conductors 34 which extend to a suitable energy source.

Figure 6:
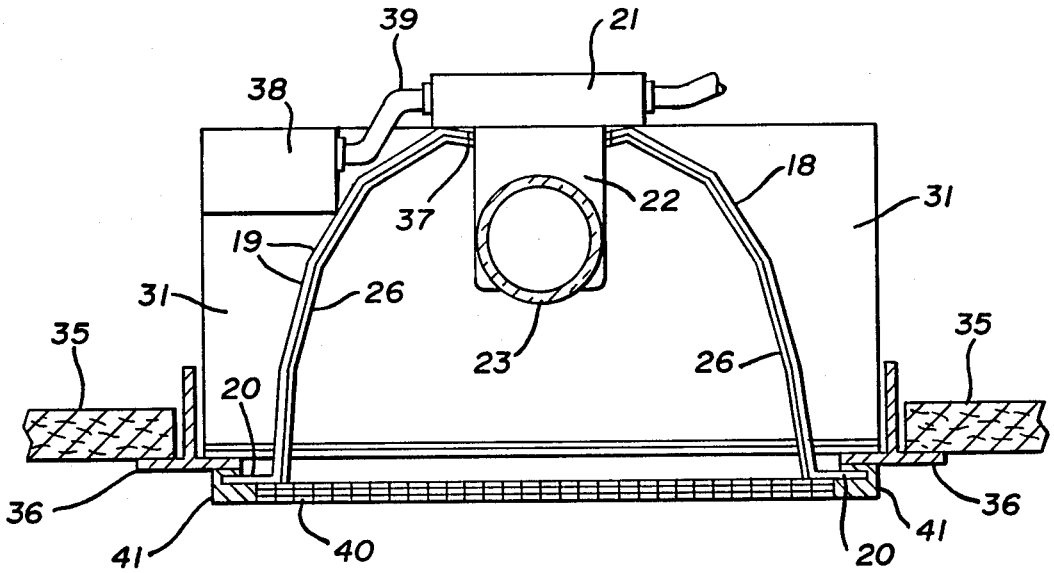
FIG. 6 is an enlarged cross sectional elevation of a fluorescent lighting apparatus embodying the present invention incorporated in a recessed fixture positioned in and above an opening in a ceiling and including a refractor lens.

It will occur to those skilled in the art that the ballast in its ballast box may be positioned in a number of locations and by referring to FIG. 6 of the drawings, an alternate location for the ballast and ballast box may be seen as well as a refractor lens which may be applied to the improved apparatus disclosed herein when the exceedingly bright multiple reflections of the fluorescent light may otherwise distract a potential customer from the merchandise being displayed and illuminated.

In FIG. 6 of the drawings, a ceiling 35 and T-shaped hangers 36 define an opening in which the improved fluorescent lighting apparatus is positioned. The T-shaped hangers may be suspended from an overhead support as illustrated in FIG. 5 of the drawings or alternately carried on transverse frame members, not shown, as will occur to those skilled in the art.

The apparatus of FIG. 6 comprises the modified arcuate shaped elongated structure 18 with its plurality of edge to edge flat portions 19 and the light reflective silver material 26 on its inner surfaces. The uppermost longitudinal portion of the elongated structure 18 carries the raceway 21 from which the light hangers 22 depend in order to support and energize and properly position the fluorescent tube 23. The ends of the elongated structure 18 are notched as at 37 to provide openings in which the light hangers 22 register so that the plurality of the fluorescent lighting apparatus may be positioned in end to end relation. The apparatus is provided with vertically positioned brackets 31 to which the ends of the elongated structure 18 are affixed with the opposite outer ends of the vertically positioned brackets 31 being supported by the T-shaped hangers 36. A ballast box 38 is attached to the bracket 31 and communicates by way of a cable 39 with the raceway 21. In order that a refractor lens 40 may be positioned across the opening defined by the outturned longitudinally extending flanges 20 of the elongated structure 18, the brackets 31 are so positioned as to locate the outturned flanges 20 below the lower surfaces of the T-shaped hangers 36. The opposite sides of the refractor lens 40 are provided with upturned and inturned flanges to form a configuration 41 that will register over the outturned flanges 20 of the elongated structure 18, one of the longitudinal edge configurations 41 being movable with respect to the actual lens 40.

Those skilled in the art will observe that the improved fluorescent lighting apparatus of the present invention enables supermarkets and other retail establishments that depend on fluorescent lighting to achieve improved lighting and at the same time reduce the costs of that lighting, both maintenance and energy costs, more than 50% from the conventional costs now common.

Those skilled in the art will observe that by utilizing the fluorescent lighting apparatus of the present invention, available color corrected fluorescent tubes can be used over meat counters where customary incandescent spotlights and conventional fluorescent fixtures have heretofore been used. The color corrected tubes and even distribution of light from a strip of the improved fluorescent lighting apparatus considerably improve the appearance of meats in the meat counter and all together operate at considerable savings as no incandescent spotlights are necessary and an even illumination of the meat is obtained.

In the lighting of produce and flowers as now sold in various supermarkets, the present improved fluorescent lighting apparatus and color corrected fluorescent tubes improve the display considerably and make the goods much more attractive due to even light distribution.

The heretofore common practice of using spot applications to highlight merchandise using three 150 watt incandscent bulbs is advantageously replaced by a single 62 watt 8 foot fluorescent fixture resulting in all of the increased "spotlighting" desired but over a greater area and of a controlled color when desired and at very substantial savings in energy for operation. The initial installations of the improved fluorescent lighting apparatus of the present invention installed on or in the ceilings of establishments with lower than average ceiling heights resulted in the appearance, from below, of multiple exceedingly bright strips of light from the novel reflectors used in the improved apparatus which sometimes attracted the customer's attention which should obviously be directed to the merchandise being illuminated. The application of the refractor lenses to the fixtures completely eliminated the visual appearance of multiple bright strips of light without reducing the actual lumens delivered to the merchandise and eliminated the tendency of the customers to direct their attentions to the light sources rather than the merchandise on sale.

It will thus be seen that the various forms of the improved fluorescent lighting apparatus disclosed herein serve to improve lighting efficiency and to improve energy economy. While preferred embodiments of the apparatus according to the invention have been described and shown in the drawings, many modifications thereof may be made by a person skilled in the art without departing from the spirit of the invention and it is intended to protect by Letters Patent all forms of the invention falling within the scope of the following claims.

Having thus described my invention, what I claim is:

1. In fluorescent lighting apparatus of the type having one fluorescent tube and elongated structures supporting the same, an improved fluorescent lighting apparatus, the improvement comprising: an elongated structure formed in a modified arcuate configuration positioned radially of and partially surrounding said fluorescent tube and defining an elongated downward facing opening of a known width, an elongated hollow raceway positioned on the upper surface of said elongated structure for reinforcing said elongated structure and for providing an enclosure for current conductors, light hangers on said raceway supporting said fluorescent tube and an elongated reflector means on the inside of said elongated structure, said elongated reflector means formed of a plurality of elongated planar mirrors arranged in a modified arcuate configuration so that said fluorescent tube is centrally positioned with respect to said reflector means and said elongated structure, said elongated planar mirrors being angularly disposed and having adjoining edges such that the planes defined by each of said adjacent planar mirrors intersect at a line defined by the adjoining edges to define included angles disposed to reflect light from said fluorescent tube in a direction away from said fluorescent tube and outwardly and downwardly through said downward facing opening whereby said reflected light is distributed in substantially equal amounts across the width of said opening and whereby said fluorescent lighting apparatus appears to have a light source of a width equal to the known width of said downward facing opening.

2. In fluorescent lighting apparatus of the type having one fluorescent tube and elongated structures supporting the same, an improved fluorescent lighting apparatus, the improvement comprising: an elongated structure formed with a plurality of elongated transversely flat panels arranged in a modified arcuate configuration positioned radially of and partially surrounding said fluorescent tube and defining an elongated downward facing opening of a known width, an elongated hollow body member positioned on the upper surface of said elongated structure for reinforcing said elongated structure and providing an enclosure for current conductors, light hangers on said hollow body member for supporting said fluorescent tube and elongated silver reflector means on the inside of said elongated structure, said reflector means having a plurality of elongated planar surfaces each registering with an associated one of said elongated flat panels, said planar surfaces being angularly disposed and having adjoining edges such that the planes defined by each of said adjacent planar surfaces intersect at a line defined by the adjoining edges to define included angles disposed to reflect light from said fluorescent tube in a direction away from said fluorescent tube and outwardly and downwardly through said downward facing opening whereby said reflected light is distributed in substantially equal amounts across the width of said downward facing opening and whereby said fluorescent lighting apparatus appears to have a light source of a width equal to the known width of said downward facing opening.

3. The improvement in fluorescent lighting apparatus set forth in claim 1, said plurality of elongated planar mirrors comprising parallel angularly disposed flat reflective segments of said elongated reflector means in said elongated structure.

4. The improvement in fluorescent lighting apparatus set forth in claim 1 wherein said plurality of elongated planar mirrors have reflective surfaces of high reflective efficiency.

5. The improvement in fluorescent lighting apparatus set forth in claim 1, wherein said elongated planar mirrors comprise parallel arcuately angularly disposed flat reflective segments of a continuous reflector body means.

6. The improvement in a fluorescent light apparatus set forth in claim 1, wherein said elongated reflector means is an integral body member supporting said plurality of elongated planar mirrors.

7. The improvement in fluorescent lighting apparatus set forth in claim 1 and wherein said elongated reflector means is an integral body member comprising a segmented curved structure having parallel flat surfaces carrying said elongated planar mirrors.

8. The improvement of fluorescent lighting apparatus set forth in claim 2, said plurality of elongated planar surfaces and the associated elongated flat panels comprising parallel angularly disposed flat reflective segments.

9. The improvement in fluorescent lighting apparatus set forth in claim 2 wherein said plurality of elongated planar surfaces have reflective surfaces of high reflective efficiency.

10. The improvement in fluorescent lighting apparatus set forth in claim 2, wherein said elongated planar surfaces and the associated elongated flat panels comprise parallel arcuately angularly disposed flat reflective segments of a continuous reflector body means.

11. The improvement in a fluorescent lighting apparatus set forth in claim 2, wherein said elongated silver reflector means is an integral body member forming said plurality of elongated planar surfaces.

12. The improvement in fluorescent lighting apparatus set forth in claim 2 and wherein said elongated silver reflector means is an integral body member comprising a segmented curved structure having parallel flat surfaces carrying said elongated planar surfaces.

13. A reflector assembly for use in a lighting fixture of the type comprising at least one elongated lighting element defining a first longitudinal axis, the reflector assembly comprising:

an elongated partial enclosure of modified arcuate cross-section defining an elongated opening of predefined width located to define a bottom of the partial enclosure, the partial enclosure further defining a second longitudinal axis and positioned such that the first and second longitudinal axes are substantially parallel to one another, said reflector assembly including means for mounting the lighting element such that the lighting element lies substantially in the upper half of the partial enclosure;

the partial enclosure comprising a plurality of planar reflective surfaces, each planar surface defining a respective width and angular and positional orientation relative to the first longitudinal axis such that light from the lighting element is substantially uniformly transmitted through the elongated opening of the partial enclosure, said planar reflective surfaces being angularly disposed and having adjoining edges such that the planes defined by each of said adjacent planar reflective surfaces intersect at a line defined by the adjoining edges to define included angles disposed to reflect light from said fluorescent tube such that reflected light is distributed in substantially equal amounts across the width of said opening and whereby said fluorescent lighting apparatus appears to have a light source of a width equal to the known width of said downward facing opening.

14. A reflector for use in a lighting fixture of the type comprising at least one elongated lighting element defining a first central longitudinal axis, the reflector comprising:

an elongated partial enclosure of modified arcuate cross-section defining an elongated opening of predefined width located to define a bottom of the partial enclosure, the partial enclosure further defining a second central longitudinal axis and positioned such that the second central longitudinal axis is below and substantially parallel to the first central longitudinal axis;

the partial enclosure comprising a plurality of planar reflective surfaces, each planar surface defining a respective width and angularly and positional orientation relative to the first longitudinal axis such that light from lighting element disposed along said first central longitudinal axis is substantially uniformly transmitted through the elongated opening of the partial enclosure said planar reflective surfaces being angularly disposed and having adjoining edges such that the planes defined by each of said adjacent planar reflective surfaces intersect at a line defined by the adjoining edges to define included angles disposed to reflect light from said fluorescent tube such that reflected light is distributed in substantially equal amounts across the width of said opening and whereby said fluorescent lighting apparatus appears to have a light source of a width equal to the predefined width of said elongated opening.

15. A reflector assembly for use in a lighting fixture of the type comprising at least one elongated lighting element defining a central longitudinal axis, the reflector assembly comprising:

an elongated central region oriented parallel to the central longitudinal axis and positioned above the lighting element;

a plurality of first elongated panels oriented parallel to the central longitudinal axis;

a plurality of second elongated panels oriented parallel to the central longitudinal axis;

the plurality of first and second elongated panels positioned on opposite sides of the central region and positioned to partially surround the lighting element and to form underneath the lighting element a downwardly facing elongated opening, said reflector assembly including means for mounting said at least one lighting element, and wherein the central region and plurality of first and second panels are positioned such that the lighting element is substantially in the upper half of the reflector;

each of the first and second panels defining a width and orientation relative to the central longitudinal axis so as to direct the emitted light away from the lighting element and through the downwardly facing opening such that the light source appears from directly below the opening to be of substantially uniform intensity and of width substantially equal to that of the downwardly facing opening, said elongated panels having adjoining edges such that the planes defined by adjacent elongated panels intersect at a line defined by the adjoining edges to define including angles disposed to distribute the reflected light in substantial equal amounts across the width of said opening.

* * * * *